US010905250B2

(12) United States Patent
Pettersson et al.

(10) Patent No.: US 10,905,250 B2
(45) Date of Patent: Feb. 2, 2021

(54) PLAY TABLE WITH TABLET ADJUSTOR MECHANISM

(71) Applicant: Volvo Car Corporation, Gothenburg (SE)

(72) Inventors: Hanna Pettersson, Gothenburg (SE); Eric Gunnarsson Hörnsten, Gothenburg (SE); Jonas Göthlin, Gothenburg (SE); Conny Blommé, Gothenburg (SE); Matilda Johansson, Gothenburg (SE); Fredrik Stråhlin, Gothenburg (SE)

(73) Assignee: Volvo Car Corporation, Göteborg (SE)

( * ) Notice: Subject to any disclaimer, the term of this patent is extended or adjusted under 35 U.S.C. 154(b) by 0 days.

(21) Appl. No.: 16/282,387

(22) Filed: Feb. 22, 2019

(65) Prior Publication Data

US 2020/0268167 A1 Aug. 27, 2020

(51) Int. Cl.

| | |
|---|---|
| ***A47D 3/00*** | (2006.01) |
| ***A47B 23/06*** | (2006.01) |
| ***A47B 23/00*** | (2006.01) |

(52) U.S. Cl.

CPC ..... *A47D 3/00* (2013.01); *A47B 23/002* (2013.01); *A47B 23/06* (2013.01)

(58) Field of Classification Search

CPC ..... A47D 3/00; A47B 23/002; A47B 23/06; A47B 23/042; A45C 15/00

USPC ..... 108/25, 42–44; 248/451–453, 444; 190/11

See application file for complete search history.

(56) References Cited

U.S. PATENT DOCUMENTS

| | | | | | |
|---|---|---|---|---|---|
| 1,797,889 | A | * | 3/1931 | Wiberg | A47B 23/043 248/454 |
| 2,489,553 | A | * | 11/1949 | Henderson | A47B 23/043 190/1 |
| 2,628,659 | A | * | 2/1953 | Carpenter | A47B 83/02 190/8 |
| 3,104,895 | A | * | 9/1963 | Feuerbach et al. | B60N 3/002 248/455 |
| 3,338,629 | A | * | 8/1967 | Drees | B60N 3/002 312/235.8 |

(Continued)

FOREIGN PATENT DOCUMENTS

| | | | |
|---|---|---|---|
| FR | 2465438 | * | 3/1981 |
| WO | 2014101235 | * | 7/2014 |

*Primary Examiner* — Janet M Wilkens

(74) *Attorney, Agent, or Firm* — Clements Bernard Walker; Christopher L. Bernard

(57) ABSTRACT

A play table includes a base member, a door member, and a rotatable adjustor mechanism for securely holding items of different sizes on the play table. The base member includes side walls and a top wall extending between the side walls to form a storage compartment therein. The top wall includes a recessed, exterior, working surface. The door member is hingedly connected to one of the side walls for selectively opening and closing the storage compartment. The adjustor mechanism is rotatably attached to the top wall and includes an upper retention member, a lower mounting member, and a spring-loaded shaft member. The adjustor mechanism is spring-loaded to provide a biasing force against the item placed on the working surface to securely hold the item on the play table.

20 Claims, 8 Drawing Sheets

(56) References Cited

U.S. PATENT DOCUMENTS 3,408,032 A * 10/1968 Francis ..... A47B 23/007 248/450
3,983,976 A * 10/1976 Taylor ..... A45C 15/00 190/18 R
4,053,133 A * 10/1977 Kauffman ..... B60R 7/08 248/452
4,483,427 A 11/1984 Gerch
4,531,642 A * 7/1985 Racich ..... B43L 13/005 211/42
4,553,728 A * 11/1985 Corsello ..... A47B 23/007 248/444.1
4,619,386 A * 10/1986 Richardson ..... B60R 7/06 108/44
4,702,453 A * 10/1987 Bishop ..... A47B 23/06 248/447.2
4,815,623 A 3/1989 Levin
4,892,334 A * 1/1990 Sinclair ..... B43L 3/001 108/42
5,115,893 A 5/1992 Terkildsen
5,797,578 A * 8/1998 Graffeo ..... A47B 23/043 248/453
5,894,922 A 4/1999 Miller et al.
6,173,656 B1 1/2001 Blanchard
8,393,584 B2 3/2013 Burns
8,746,156 B2 6/2014 Camarillo
8,770,536 B2 * 7/2014 Hu ..... G01R 31/2808 248/447
8,910,838 B2 12/2014 Palmer et al.
8,925,886 B2 * 1/2015 Sears ..... F16M 11/041 248/220.21
D753,766 S * 4/2016 Chuang ..... D19/88
9,743,759 B1 11/2017 Ramirez et al.
9,999,298 B1 6/2018 Sullins
2004/0163913 A1 * 8/2004 Tschudy ..... A45C 5/06 190/111
2005/0285009 A1 * 12/2005 Phifer ..... A47B 23/044 248/444
2006/0174530 A1 * 8/2006 Chang ..... A47G 1/06 40/739
2007/0125926 A1 * 6/2007 Phifer ..... A47B 23/042 248/451
2009/0045314 A1 * 2/2009 Lien ..... G09F 1/103 248/452
2010/0019118 A1 * 1/2010 Nagpal ..... A45C 5/02 248/460
2011/0127304 A1 * 6/2011 Kam ..... A47B 23/002 224/153
2012/0212896 A1 * 8/2012 Schulz ..... A45C 11/00 361/679.02

* cited by examiner

PLAY TABLE WITH TABLET ADJUSTOR MECHANISM

TECHNICAL FIELD

The present invention relates generally to a play table for use in a vehicle or the like. More specifically, the present invention relates to a play table with a tablet adjustor mechanism for holding a tablet or the like.

BACKGROUND ART

While traveling in a vehicle, for example, people allow children in the back seat play with various items, such as electronic devices and the like. One reason is to provide entertainment for the children in an attempt to travel farther without hearing complaints from the back seat. During use, the electronic device, such as a tablet or the like, is usually positioned directly on the lap of the user, in an awkward ergonomic position, particularly related to the neck and back. In addition, the electronic devices may be spread all over the back seat when not in use, resulting in damage.

One solution to these problems is to provide a play table or cushion that is rested on the user's lap and tilts the tablet toward the user to provide a better ergonomic position. One such conventional play table uses a standard clip mechanism to hold the tablet in place when in use. Although this solution is simple to use, the clip mechanism cannot accommodate items, such as electronic devices and the like, of different sizes. Further no organization or storage capability is provided.

SUMMARY

The problem of accommodating items of different sizes for use with a play table is solved by providing a spring-loaded adjustor mechanism that is rotatably attached to a top surface of the play table that is capable of securely holding items of different sizes when the items are placed on the play table. The play table has an ergonomic wedge shape to angle the items towards the user and the bottom surface, which can serve as a play surface, opens to reveal a storage compartment inside. One or more storage pockets are provided in the storage compartment for holding smaller items. The play table includes a strap for easy over-the-shoulder transport of the play table and any items stored in the storage compartment.

In one exemplary embodiment, the play table for holding and storing an item provided herein includes: a base member including a first pair of opposing side walls, a second pair of opposing side walls, and a top wall extending between the first and second pairs of opposing side walls to define a storage compartment therebetween; a door member disposed opposite the top wall and hingedly connected to, and optionally integrally formed with, one wall of the first and second pairs of opposing side walls, the door member adapted to provide access to the storage compartment; and an adjustor mechanism rotatably coupled to the top wall, the adjustor mechanism adapted to securely hold the item when the item is placed on an exterior surface of the top wall of the play table. The adjustor mechanism includes one of a spring mechanism and a damper mechanism adapted to provide a biasing force against the item when the item is placed on the exterior surface of the top wall of the play table. The adjustor mechanism includes an upper retention member, a lower mounting member, and a shaft member disposed therebetween.

In another exemplary embodiment, the adaptor mechanism for securing an item to a play table provided herein includes: an upper retention member adapted to engage the item when the item is disposed on an exterior surface of a top wall of the play table; a lower mounting member adapted to be coupled to the top wall of the play table; and a rotatable shaft member disposed between the upper retention member and the lower mounting member. The adaptor mechanism also includes a spring mechanism coupling the rotatable shaft member to the lower mounting member, the spring mechanism adapted to provide a biasing force against the item when the item is disposed on the exterior surface of the top wall of the play table. The upper retention member includes an upper portion and a lower portion, the upper portion having a width that is greater than a width of the lower portion such that the upper portion overhangs the lower portion.

BRIEF DESCRIPTION OF THE DRAWINGS

While various embodiments of the invention are illustrated, the particular embodiments shown should not be construed to limit the claims. It is anticipated that various changes and modifications may be made without departing from the scope of the invention.

DESCRIPTION OF EMBODIMENTS

Figure 1:
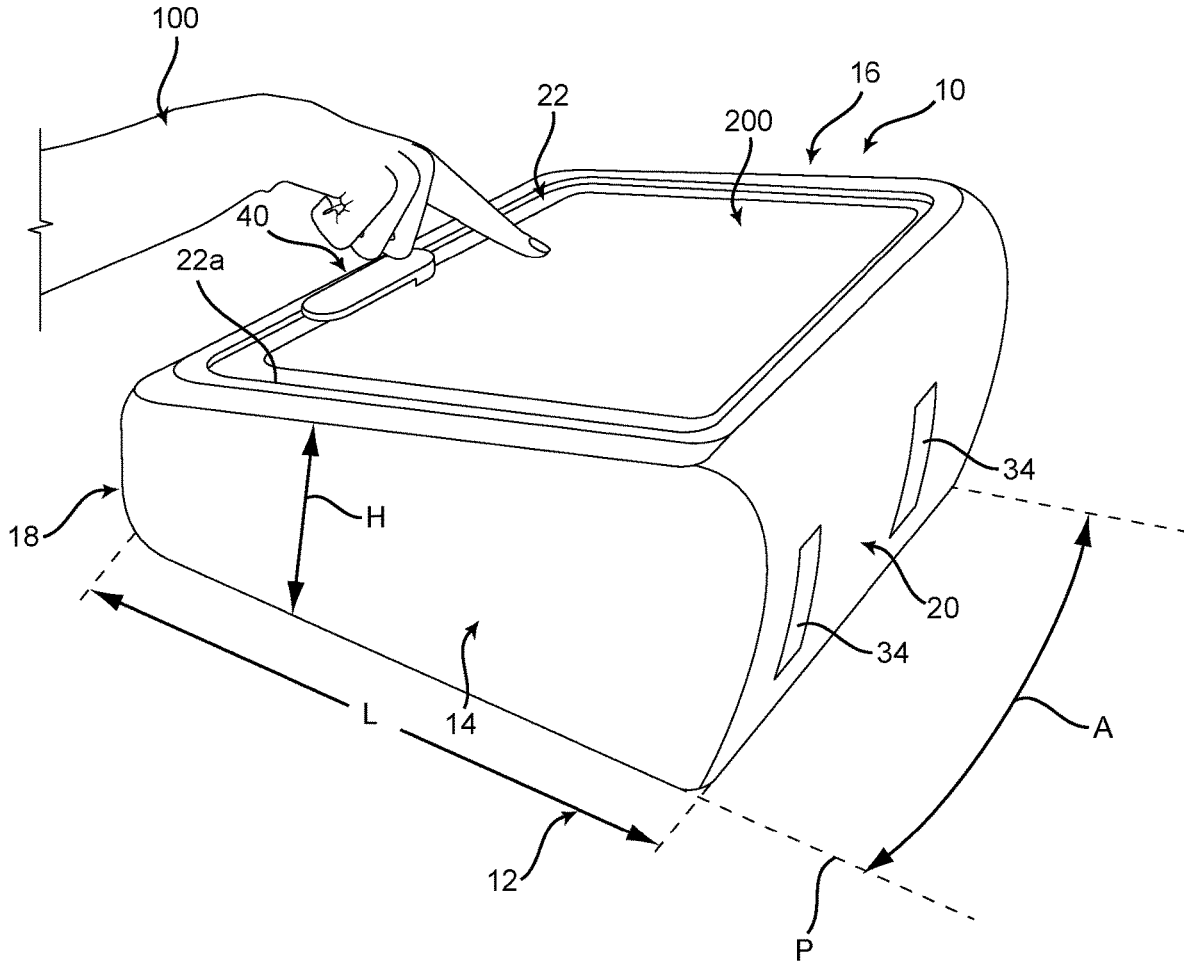
FIG. 1 is a top perspective view of a play table including a rotatable adjustor mechanism for accommodating items of different sizes (in use) according to an embodiment of the invention.

Again, the problem of accommodating items of different sizes for use with a play table is solved by providing a spring-loaded adjustor mechanism that is rotatably attached to a top surface of the play table that is capable of securely holding items of different sizes when the items are placed on the play table. The play table has an ergonomic wedge shape to angle the items towards the user and the bottom surface, which can serve as a play surface, opens to reveal a storage compartment inside. Various storage pockets are provided in the storage compartment for holding smaller items. The play table includes a strap for easy over-the-shoulder transport of the play table and any items stored in the storage compartment.

Referring now to FIGS. 1-4, the play table 10 includes a base member 12 that includes a first pair of opposing side walls 14, 16, a second pair of opposing side walls 18, 20, and a top wall 22 extending between the first and second pairs of opposing side walls 14, 16, 18, 20. The first pair of opposing side walls 14, 16 are substantially parallel to each other and extend approximately perpendicularly with respect to the second pair of opposing side walls 18, 20. Similarly, the second pair of opposing side walls 18, 20 are substantially parallel to each other and extend approximately perpendicularly with respect to the first pair of opposing side walls 14, 16. Each of the side walls 14, 16, 18, 20 and the top wall 22, and any combination thereof, can be substantially planar or slightly curved (i.e., concave or convex). For example, the side wall 18 can be slightly curved, while the side walls 14, 16, and 20 and the top wall 22 can be substantially planar. As can be understood, each of the side walls 14, 16, 18, 20 and the top wall 22 are substantially quadrilateral in shape.

As shown in FIG. 1, each of the side walls 14, 16, 18, 20 have a length, L, and a height, H. In the illustrated embodiment, the first pair of opposing side walls 14, 16 are substantially identical in shape having a height, H, that continuously varies along the length, L. Specifically, the height, H, proximate the side wall 18 is less than the height, H, proximate the side wall 20. As a result, the top wall 22 is tilted at an angle, A, with respect to a horizontal plane, P, that is substantially parallel to the lap of a user 100 that contacts the play table 10 when in use. In addition, the second pair of opposing side walls 18, 20 have approximately the same length, L, but have different heights, H. Specifically, the height, H, of the side wall 18 is less than the height, H, of the side wall 20. This provides the base member 12 with the desired tapering wedge shape.

It will be appreciated that the side walls 14, 16, 18, 20 and the top wall 22 can be made of any suitable material for a play table, such as rigid foam material, an impact-resistant plastic material, or the like. For example, the first and second pairs of opposing side walls 14, 16, 18, 20 and the top wall 22 can be made of an expanded polypropylene (EPP) material using a well-known molding process. EPP foam material is desirable because of its heat resistance, elasticity, and recyclability, making it a green choice.

Figure 6:
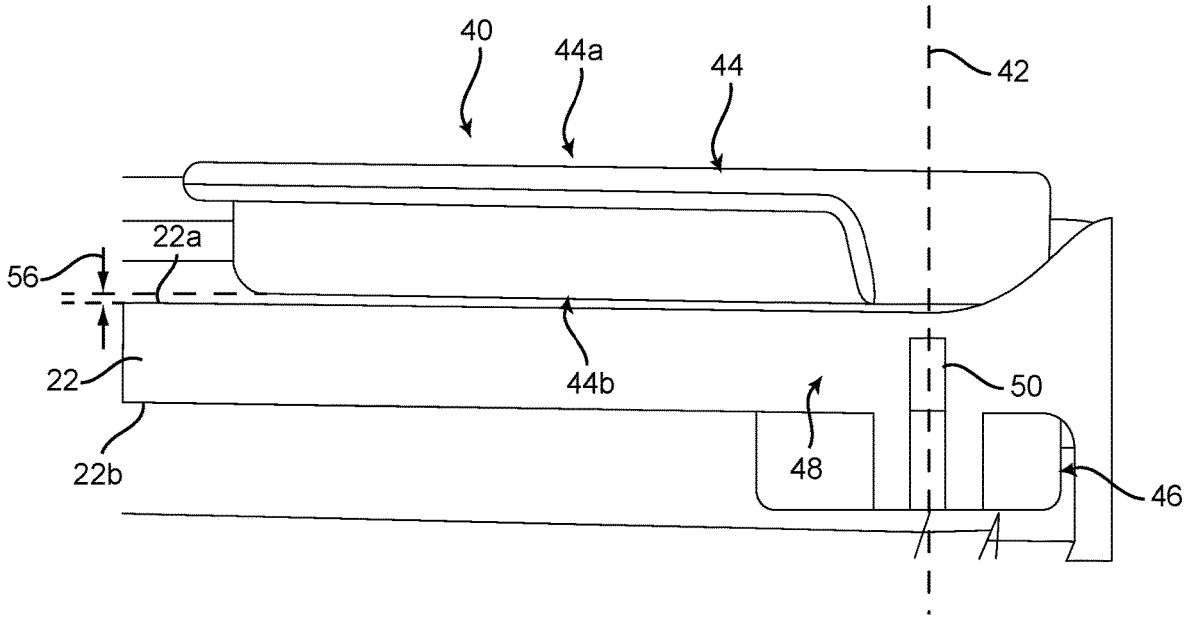
FIG. 6 is a side view of the rotatable adjustor mechanism of FIG. 5 when attached to the top surface of the play table.
Figure 7A:
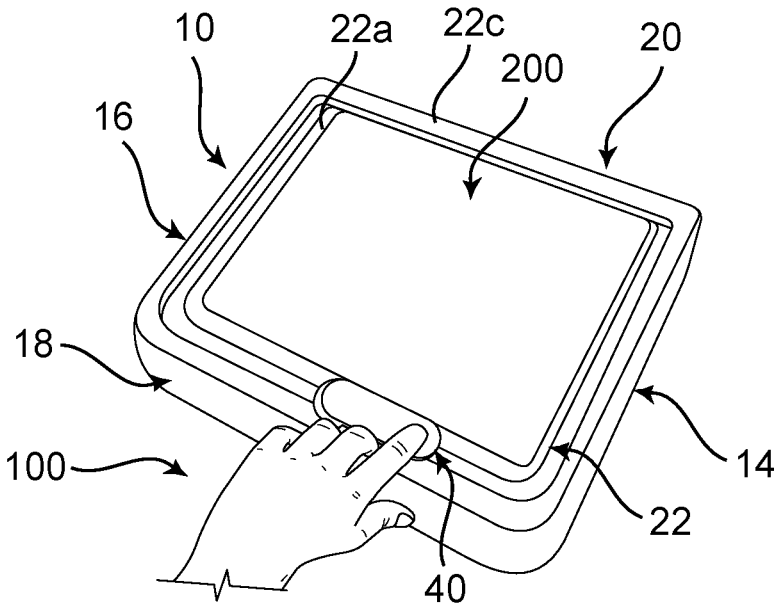
FIGS. 7(*a*) and 7(*b*) are top perspective views of the play table of FIG. 1 showing a method of securely holding an item, such as a large tablet, on the play table by moving the rotatable adjustor mechanism from a non-actuated position to an actuated position, respectively.
Figure 7B:
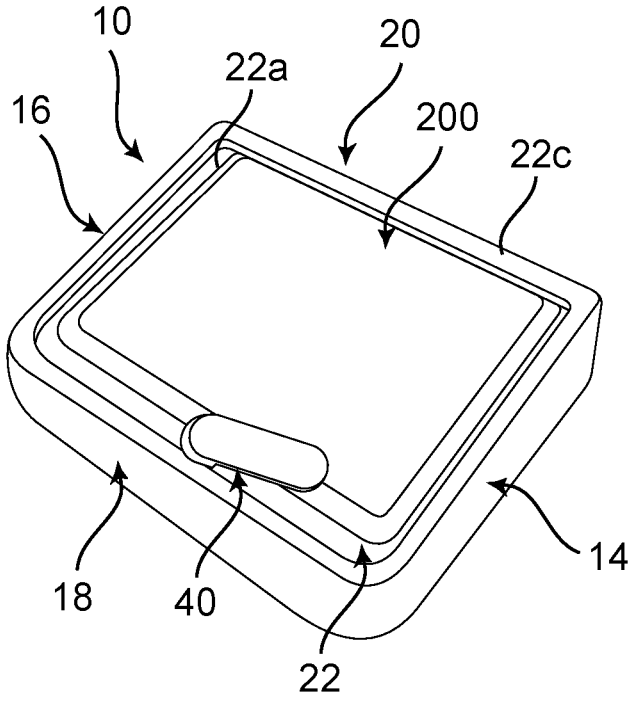
Figure 8A:
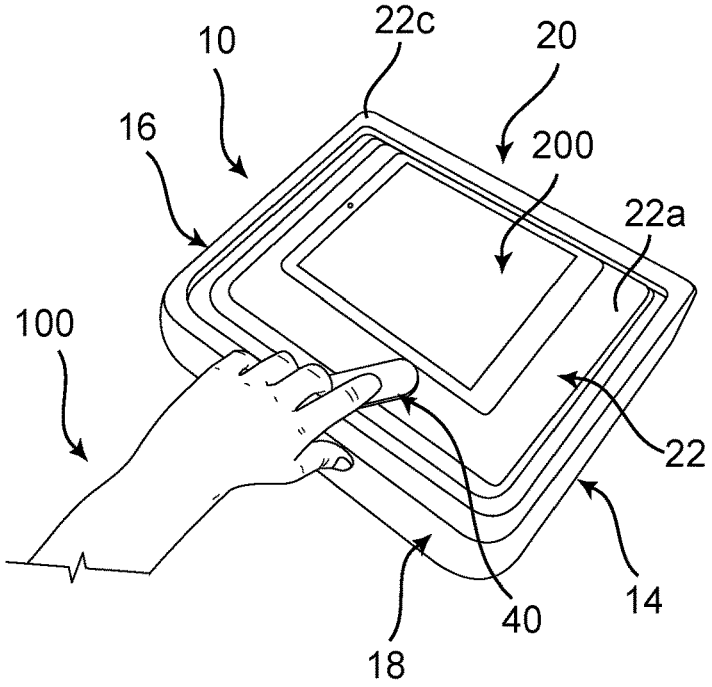
FIGS. 8(*a*) and 8(*b*) are top perspective views of the play table of FIG. 1 showing a method of securely holding an item, such as a small tablet, on the play table by moving the rotatable adjustor mechanism from a non-actuated position to an actuated position, respectively.
Figure 8B:
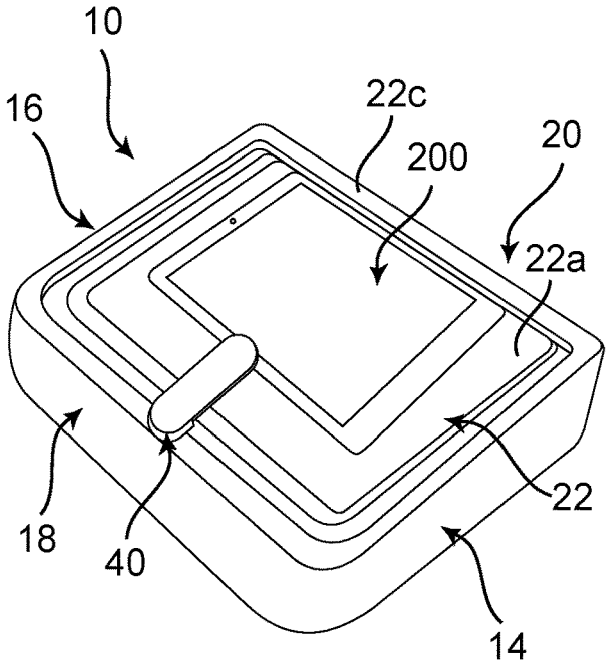

The top wall 22 has an exterior, working surface 22*a* and an opposite, interior surface 22*b* (FIG. 6). The exterior, working surface 22*a* is recessed with respect to a ledge 22*c* that extends the entire perimeter of the play table 10. The exterior, working surface 22*a* is recessed a depth, D, that is sufficient to accommodate and retain items, such as electronic devices and the like, when placed on the exterior, working surface 22*a*. During use, the ledge 22*c* acts as a stop and provides an indication to the user 100 that the item 200 is properly placed on the exterior, working surface 22*a*. In one example, the user 100 may place the item 200 on the exterior, working surface 22*a* such that the item 200 abuts the ledge 22*c* proximate the side wall 20 (FIGS. 7 and 8). It should be noted that the exterior, working surface 22*a* can be covered with the same material as the rest of the top wall 22 or it can be covered with a different material. For example, the exterior, working surface 22*a* of the top wall 22 can be covered with a fabric material, such as felt or the like, and the rest of the top wall 22 can be exposed EPP foam material.

The play table 10 further includes a door member 24 opposite the top wall 22 for selectively providing access to a storage compartment 26 formed by the side walls 14, 16, 18, 20 and the top wall 22. To this end, the door member 24 is hingedly connected to one of the side walls 14, 16, 18, 20. For example, in the illustrated embodiment, the door member 24 is hingedly connected to the side wall 20. One method of hingedly connecting the door member 24 to the side wall 20 is by forming a living hinge 27 between the door member 24 and the side wall 20 using a well-known molding process or the like. For example, the door member 24 and the side wall 20 can both me made of a fabric or felt material including the living hinge 27. This has the advantage of providing a comfortable surface that contacts the legs of the user. As an alternative, the side wall 20 can be a two-layer wall, with only the interior fabric or felt layer being integrally formed with the door member 24. In this case, the outer later of the side wall 20 is preferably manufactured from a more rigid material.

Figure 3:
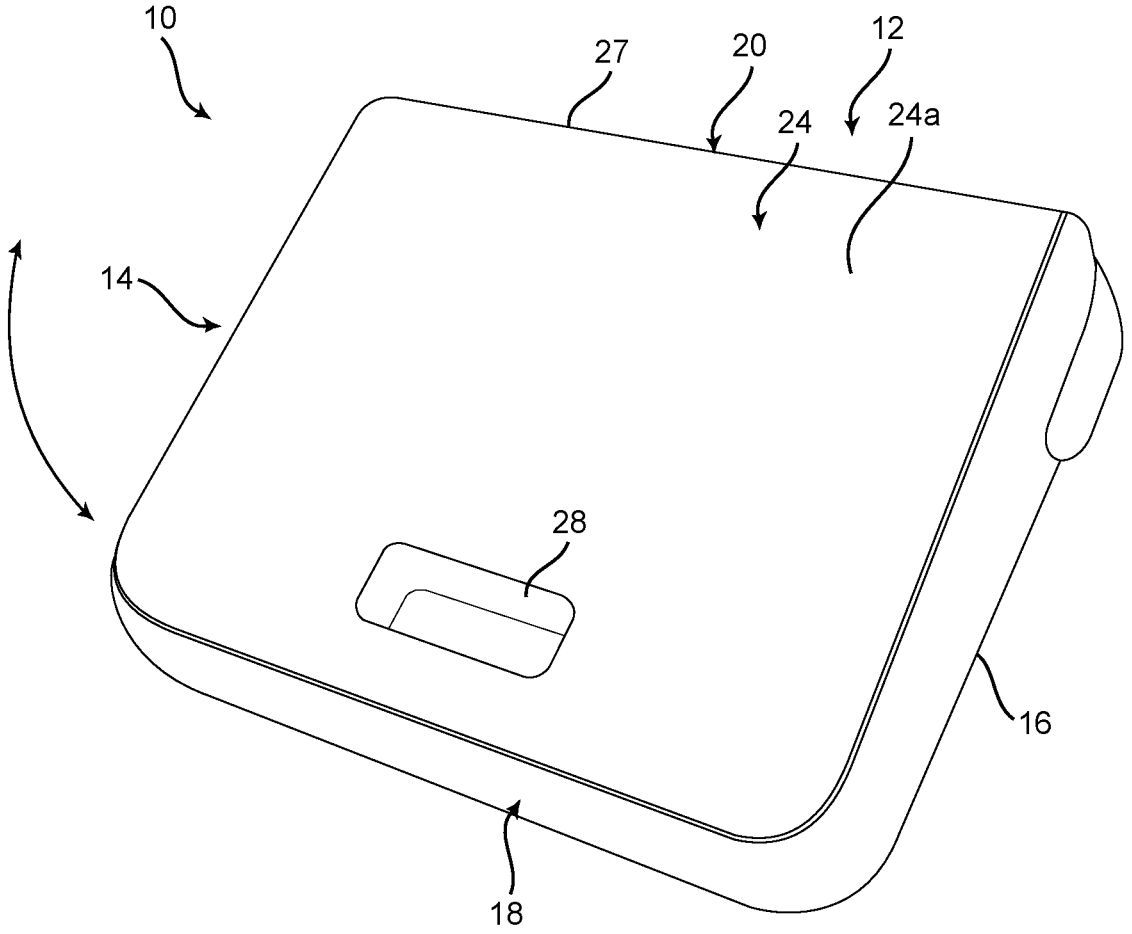
FIG. 3 is a bottom perspective view of the play table of FIG. 1 when the door member is in a closed position.
Figure 4:
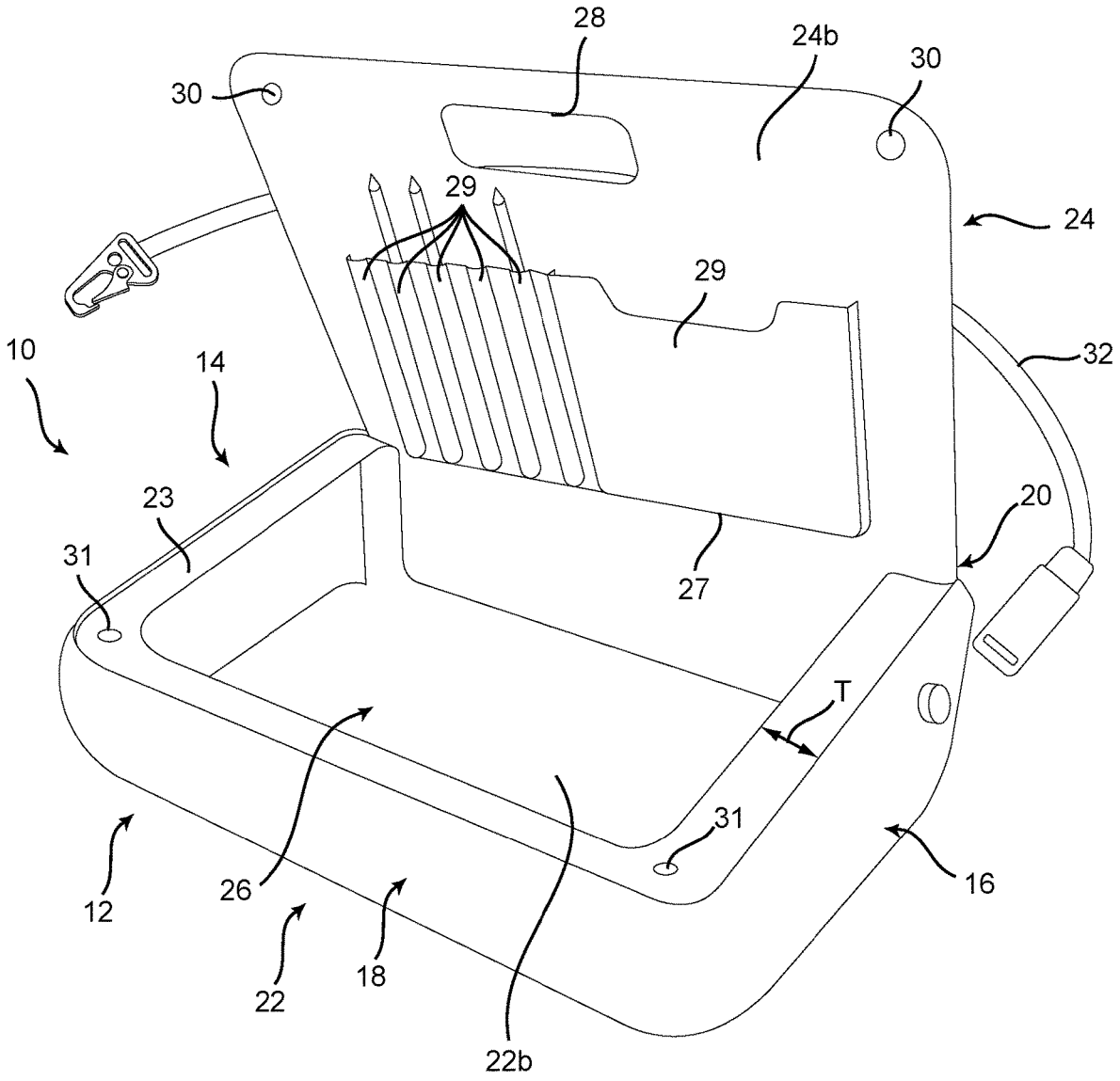
FIG. 4 is a bottom perspective view of the play table of FIG. 1 showing the internal storage compartment for storing items when the door member is in an open position.

The door member 24 has an exterior surface 24*a* (FIG. 3) and an interior surface 24*b* (FIG. 4). The exterior surface 24*a* may be coated with a fabric or felt material for comfort and aesthetics. The interior surface 24*b* may include one or more pockets 29. The pockets 29, if more than one are used, can be the same dimensions or different dimensions. In the illustrated embodiment, one pocket 29 is generally rectangular in shape for accommodating a book or the like, while other adjacent pockets 29 are elongate in shape for accommodating objects, such as pencils, pens, crayons, markers, and the like. This configuration may, of course, vary as desired.

The door member 24 includes a cutout 28 of sufficient dimensions to allow the user 100 to insert one or more fingers into the cutout 28 for accessing the storage compartment 26 and/or transporting the play table 10. As can be understood, the storage compartment 26 can be accessed by inserting one or more fingers of the user 100 into the cutout 28 and raising the door member 24 such that the door member 24 pivots about the hinge 27 (as indicated by the arrows in FIG. 3). In addition, it can be understood that the user 100 can insert one or more fingers into the cutout 28 while the door member 24 is in the closed position (FIG. 3) to transport the play table 10. In the illustrated embodiment, the cutout 28 is rectangular in shape. However, it will be appreciated that the cutout 28 can be any desired shape, so long as the user 100 can insert one or more fingers into the cutout 28.

FIG. 4 shows the door member 24 when in an open position to provide access to the storage compartment 26. The side walls 14, 16 and the side wall 18 have a thickness, T, of sufficient dimensions to enable a recessed ledge 23 to be formed therein. In one embodiment, the recessed ledge 23 has a sufficient depth to enable the door member 24 to be substantially flush with the side walls 14, 16 and the side wall 18 when the door member 24 is in a closed position (FIG. 3). The door member 24 can be securely held in the closed position by using any well-known means. For example, the interior surface 24*b* of the door member 24 may include one or more metallic members 30 that each interact with a respective magnet 31 disposed within the ledge 23. When securely held in the closed position, the play table 10 may be transported using a carrying strap 32 that can be removably attached to the play table 10 using means well-known in the art. Instead of using the carrying strap 32, the play table 10 can also be transported by the user 100 inserting one or more fingers into the cutout 28, as mentioned above. It should be noted that the side wall 20 includes one or more legs 34 (FIG. 1). When transporting the play table 10 using the cutout 28, the play table 10 may be easily placed in an upright position by resting the play table 10 on the one or more legs 34.

Figure 5:
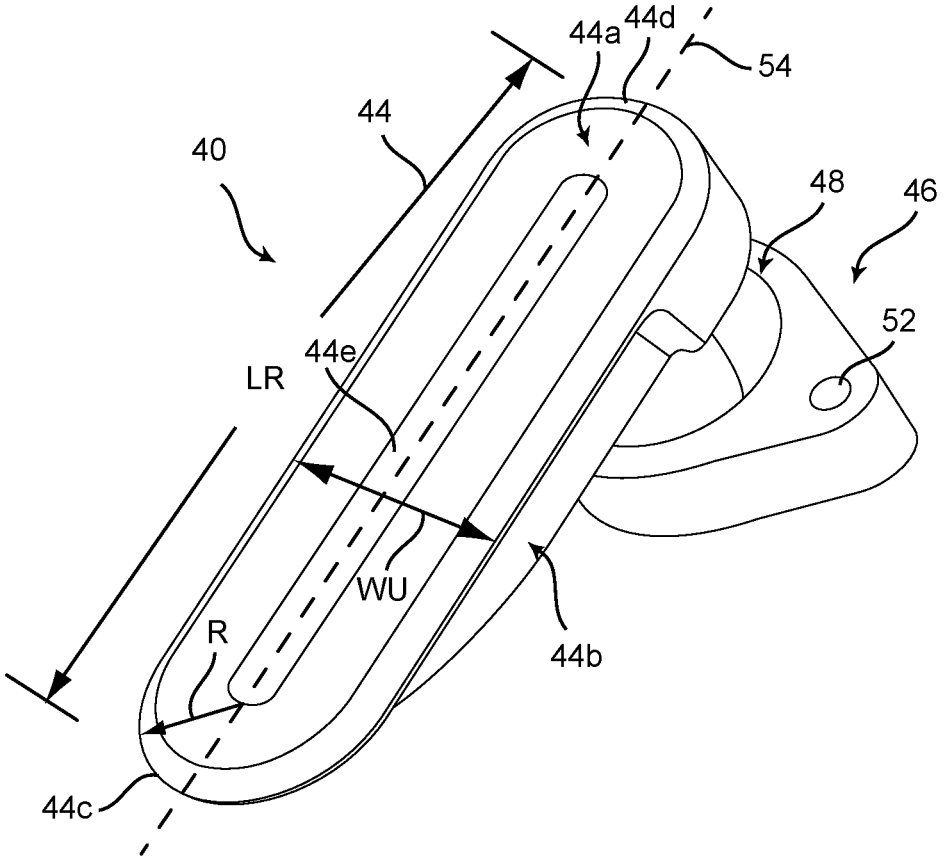
FIG. 5 is a top perspective view of the rotatable adjustor mechanism according to an embodiment of the invention.

One aspect of the invention is that the play table 10 includes a rotatable adjustor mechanism, shown generally at 40, for securely holding items of different sizes when placed on the top wall 22 of the play table 10. Referring now to FIGS. 5 and 6, the adjustor mechanism 40 is rotatable about an axis of rotation 42 disposed perpendicular to the top wall 22 such that the adjustor mechanism 40 can be easily rotated by the user 100 from a non-actuated position (FIG. 7(*a*)) to an actuated position (FIG. 7(*b*)). The rotation occurs across the exterior surface 22*a* of the top wall 22.

The adjustor mechanism 40 includes an upper retention member 44 located on one side of the top wall 22, a lower mounting member 46 located on the opposite side of the top wall 22 and a shaft member 48 disposed therebetween. When properly mounted on the top wall 22, the upper retention member 44 is disposed proximate the exterior surface 22*a* of the top wall 22, the lower mounting member 46 is disposed proximate the interior surface 22*b* of the top wall 22, and the shaft member 48 passes entirely through the top wall 22. Alternatively, the lower mounting member 46 is disposed on the exterior surface 22*a* of the top wall 22, potentially with the attached fabric or felt material disposed on the exterior surface 22*a* of the top wall 22 covering the lower mounting member 46. In this case, the lower mounting member 46 may be disposed within a recess manufactured into the exterior surface 22*a* of the top wall 22. It will be readily apparent to those of ordinary skill in the art that any suitable type of lower mounting member 46 may be used equally.

The upper retention member 44 has an elongated shape having a sufficient length, LR, to allow the upper retention member 44 to contact items 200 having different sizes when placed on the top wall 22. The upper retention member 44 has an upper portion 44*a* and a lower portion 44*b* that are symmetrically disposed about a central, longitudinal axis 54. The upper portion 44*a* has a width, WU, that is larger than a width of the lower portion such that the upper portion 44*a* overhangs the lower portion 44*b*. One or both ends 44*c*, 44*d* of the upper portion 44*a* may be formed with a radius, R, to provide the upper retention member 44 with an aesthetically appealing appearance. In addition, the upper portion 44*a* may include a groove 44*e* substantially aligned with the central, longitudinal axis 54 to provide the user with tactile feedback when rotating the upper retention member 44 from the at-rest position (FIG. 2) to an actuated position (FIGS. 7(*a*) and 8(*a*)).

Figure 2:
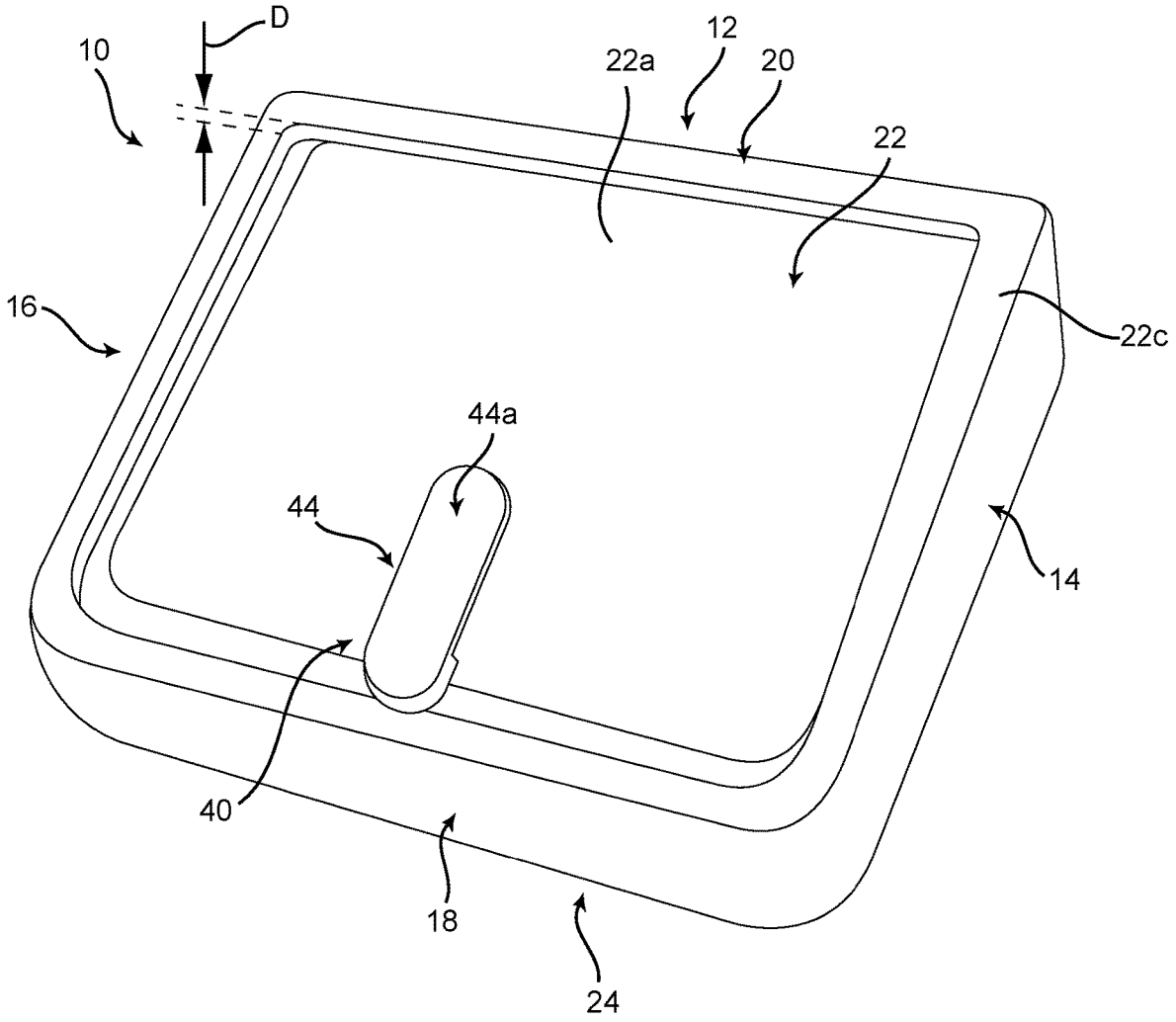
FIG. 2 is a top perspective view of the play table of FIG. 1 showing the adjustor mechanism when in at-rest position.

The lower mounting member 46 may be attached to the top wall 22 using threaded fasteners 50 inserted into holes 52 formed in the lower mounting member 46. The shaft member 48 is spring-loaded in a manner well-known in the art, which provides a biasing force against a stop (not shown) in the shaft member 48 to retain the upper retention member 44 in the non-actuated position unless acted upon by an outside force, as shown in FIG. 2. As shown in FIG. 6, a small gap 56 exists between the lower portion 44*b* and the top wall 22 to enable the adjustor mechanism 40 to freely rotate about the axis of rotation 42 when rotated by the user 100. The adjustor mechanism 40 may be biased using a spring, an elastomeric damper, or the like, or it may preferentially assume predetermined rotational positions by means of a detent mechanism, well known in the art.

Referring now to FIGS. 7 and 8, the user 100 operates the adjustor mechanism 40 by exerting a force on the adjustor mechanism 40 to rotate the adjustor mechanism 40 in a first direction (i.e., a clockwise direction) from the at-rest position (FIG. 2) to a non-actuated position, as shown in FIG. 7(*a*). In the illustrated example, the user 100 exerts a force on the adjustor mechanism 40 by using one or more fingers to cause the adjustor mechanism 40 to rotate in the clockwise direction. It should be appreciated that the adjustor mechanism 40 could be rotated in a counter-clockwise direction, rather than the clockwise direction. Then, the user 100 places an item 200, such as a tablet, on the exterior surface 22*a* of the top wall 22, which is recessed with respect to the ledge 22*c*, such that the item 200 substantially abuts the ledge 22*c* proximate the side wall 20, while maintaining the adjustor mechanism 40 in the non-actuated position, as shown in FIG. 7(*a*).

Once the item 200 is properly placed on the exterior surface 22*a*, the user 100 simply releases the adjustor mechanism 40, which is biased by the spring-loaded shank member 48 to rotate in a second, opposite direction, for example, in a counter-clockwise direction, to place the adjustor mechanism 40 in an actuated-position and securely hold the item 200 on the play table 100. When the adjustor mechanism 40 is in the actuated position, the lower portion 44*b* of the upper retention member 44 abuts the outer periphery of the item 200 and the upper portion 44*a* overhangs a portion of the item 200 that is distal the side wall 20. The force exerted by the spring-loaded shaft member 48 against the item 200 causes the adjustor mechanism 40 to continuously contact the item 200 to push the tablet against the ledge 22*c* in an interlocking relationship to securely hold the tablet on the play table 10, as shown in FIG. 7(*b*). All surfaces of the upper retention portion 44 of the adjustor mechanism 40 are rubberized or otherwise formed or coated with an anti-scratch material such that the item 200 is not damaged upon engagement.

To release the item 200 from the play table 10, the user 100 exerts a force on the adjustor mechanism 40 to overcome the biasing force of the spring-loaded shaft member 48 and rotate the adjustor mechanism 40 in the first direction (i.e., clockwise) such that the adjustor mechanism 40 is in a non-actuated position and no longer contacts the item 200. Then, the user 100 can remove the item 200 from the play table 10. Once the item 200 is removed, the user 100 can simply release the adjustor mechanism 40, which automatically rotates the adjustor mechanism 40 to the at-rest position (FIG. 2).

As mentioned above, one aspect of the play table 10 of the invention is that items of different sizes can be securely held on the play table 10, unlike conventional play tables. As shown in FIG. 8(*a*), the user 100 has rotated the adjustor mechanism 40 from the at-rest position (FIG. 2) to the non-actuated position and has placed a smaller tablet on the exterior surface 22*a* of the top wall 22 such that the item 200 abuts the ledge 22*c* proximate the side wall 20. Then, the user 100 simply releases the adjustor mechanism 40 to securely hold the smaller tablet 200 on the play table 100, as shown in FIG. 8(*b*).

As described herein, the play table 10 of the invention includes an adjustor for securely holding items, such electronic devices, and the like, of different sizes on the play table 10. Having described presently preferred embodiments, the invention may be otherwise embodied within the scope of the appended claims.

The invention claimed is:

1. A play table for holding and storing an item, the play table comprising:

a base member comprising a first pair of opposing side walls, a second pair of opposing side walls, and a top wall extending between the first and second pairs of opposing side walls to define a storage compartment therebetween;

a door member disposed opposite the top wall and hingedly connected to one wall of the first and second pairs of opposing side walls, the door member adapted to provide access to the storage compartment; and an adjustor mechanism rotatably coupled to the top wall, the adjustor mechanism adapted to securely hold the item when the item is placed on an exterior surface of the top wall of the play table;

wherein one wall of the second pair of opposing side walls has a height, H, that is greater than a height, H, of another wall of the second pair of opposing side walls.

2. The play table of claim 1, wherein the adjustor mechanism comprises one of a spring mechanism and a damper mechanism adapted to provide a biasing force against the item when the item is placed on the exterior surface of the top wall of the play table.

3. The play table of claim 1, wherein the adjustor mechanism comprises an upper retention member, a lower mounting member, and a shaft member disposed therebetween.

4. The play table of claim 3, wherein the upper retention member is disposed proximate the exterior surface of the top wall, the lower mounting member is coupled to an interior surface of the top wall, and the shaft member is disposed through the top wall.

5. The play table of claim 3, wherein the upper retention member comprises an upper portion and a lower portion, the upper portion having a width that is greater than a width of the lower portion such that the upper portion overhangs the lower portion.

6. The play table of claim 5, wherein lower portion of the upper retention member and the top wall define a gap when the adjustor mechanism is rotatably coupled to the top wall.

7. The play table of claim 5, wherein the upper portion of the upper retention member is adapted to overlap a portion of the item the lower portion of the upper retention member is adapted to contact a portion of the item when the adjustor mechanism is placed in an actuated position.

8. The play table of claim 1, wherein the top surface comprises a raised ledge disposed about a perimeter of the exterior surface thereof.

9. The play table of claim 1, wherein the door member defines a cutout adapted to receive one or more fingers of a user for transporting the play table.

10. The play table of claim 1, wherein the first pair of opposing side walls are substantially identical in shape and have a height, H, that continuously varies along a length, L, thereof.

11. A play table for holding and storing an item, the play table comprising:

a base member comprising a first pair of opposing side walls, a second pair of opposing side walls, and a top wall extending between the first and second pairs of opposing side walls to define a storage compartment therebetween;

a door member disposed opposite the top wall, wherein the door member is integrally formed with and hingedly connected to one wall of the second pair of opposing side walls, the door member adapted to provide access to the storage compartment; and an adjustor mechanism rotatably coupled to the top wall, the adjustor mechanism adapted to securely hold the item when the item is placed on an exterior surface of the top wall of the play table;

wherein the first pair of opposing side walls are substantially identical in shape and have a height, H, that continuously varies along a length, L, thereof, and wherein one wall of the second pair of opposing side walls has a height, H, that is greater than a height, H, of another wall of the second pair of opposing side walls.

12. The play table of claim 11, wherein the adjustor mechanism comprises one of a spring mechanism and a damper mechanism adapted to provide a biasing force against the item when the item is placed on the exterior surface of the top wall of the play table.

13. The play table of claim 11, wherein the adjustor mechanism comprises an upper retention member, a lower mounting member, and a shaft member disposed therebetween.

14. The play table of claim 13, wherein the upper retention member is disposed proximate the exterior surface of the top wall, the lower mounting member is coupled to an interior surface of the top wall, and the shaft member is disposed through the top wall.

15. The play table of claim 13, wherein the upper retention member comprises an upper portion and a lower portion, the upper portion having a width that is greater than a width of the lower portion such that the upper portion overhangs the lower portion.

16. The play table of claim 15, wherein lower portion of the upper retention member and the top wall define a gap when the adjustor mechanism is rotatably coupled to the top wall.

17. The play table of claim 15, wherein the upper portion of the upper retention member is adapted to overlap a portion of the item the lower portion of the upper retention member is adapted to contact a portion of the item when the adjustor mechanism is placed in an actuated position.

18. The play table of claim 11, wherein the top surface comprises a raised ledge disposed about a perimeter of the exterior surface thereof.

19. An adaptor mechanism for securing an item to a play table, the adaptor mechanism comprising:

an upper retention member adapted to engage the item when the item is disposed on an exterior surface of a top wall of the play table;

a lower mounting member adapted to be coupled to the top wall of the play table; and a rotatable shaft member disposed between the upper retention member and the lower mounting member;

wherein the upper retention member comprises an upper portion and a lower portion both extending from the rotatable shaft member and disposed along a longitudinal axis aligned perpendicular to an axis of rotation of the rotatable shaft member, wherein the upper portion has a width that is greater than a width of the lower portion such that the upper portion overhangs the lower portion.

20. The play table of claim 19, further comprising a spring mechanism coupling the rotatable shaft member to the lower mounting member, the spring mechanism adapted to provide a biasing force against the item when the item is disposed on the exterior surface of the top wall of the play table.

* * * * *